United States Patent [19]

Zieke et al.

[11] Patent Number: 4,727,709

[45] Date of Patent: Mar. 1, 1988

[54] STEERING, JOINING AND GUIDING MECHANISM FOR ZIPPERED FILM

[75] Inventors: Larry M. Zieke; R. Douglas Behr, both of Midland, Mich.

[73] Assignee: The Dow Chemical Company, Midland, Mich.

[21] Appl. No.: 889,571

[22] Filed: Jul. 25, 1986

[51] Int. Cl.[4] ..... B65B 9/08

[52] U.S. Cl. ..... 53/551; 53/567; 53/547; 226/17

[58] Field of Search ..... 53/389, 547, 550, 551, 53/567, 568; 226/17; 493/248

[56] References Cited

U.S. PATENT DOCUMENTS

| | | | |
|---|---|---|---|
| 1,995,462 | 3/1935 | Tandel | 226/17 |
| 2,146,308 | 2/1939 | Maxfield . | |
| 3,807,118 | 4/1974 | Pike . | |
| 3,815,317 | 6/1974 | Toss | 53/551 |
| 4,007,865 | 2/1977 | Crandall | 226/17 |
| 4,201,132 | 5/1980 | Zimmer et al. | 226/17 |
| 4,355,494 | 10/1982 | Tilman | 53/551 |
| 4,582,549 | 4/1986 | Ferrell | 156/66 |

*Primary Examiner*—Robert L. Spruill
*Assistant Examiner*—Donald R. Studebaker

[57] ABSTRACT

A steering, joining and guiding mechanism is disclosed for joining together opposing rib and groove fastener elements on a traveling continuous bag film. The steering, joining and guiding mechanism includes a pair of opposing press rolls. The longitudinal axis of each of the press rolls is offset from the direction of travel of the bag film. The press rolls are offset from about 2° to about 30° from a line perpendicular to the direction of travel of the bag film, and are preferably offset at about 5° from the direction of travel of the bag film.

10 Claims, 4 Drawing Figures

STEERING, JOINING AND GUIDING MECHANISM FOR ZIPPERED FILM

BACKGROUND OF THE INVENTION

This invention relates to machine for forming, filling, and sealing reclosable bags from a continuous web of bag material, and more particularly to a steering, joining and guiding mechanism for such a forming, filling, and sealing machine.

Bags of various types have been used for packaging a wide variety of products. For example, cereals, cookies, and potato chips are often packaged in bags. These bags can serve as the external packaging for the products, or can be inserted into boxes as a liner for the boxes. When packaging perishable materials such as cereal, cookies, and potato chips, the bags should be sealed, as sealed bags help to preserve the product contained therein by preventing the co-mingling of outside air and moisture with the product in the bags.

Conventional sealed bags (such as most cereal bags and potato chip bags) have seals which are formed by gluing together or heat sealing together a pair of opposed edges of the bags. One problem with such conventional sealed bags is that they cannot be resealed after being opened. Thus, once the bag is opened, the user cannot prevent the unwanted intrusion of outside air and moisture into the bag.

Reclosable bags are known. Usually, reclosable bags include a pair of fastener elements (such as a pair of rib and groove profiles or "zippers"), which the user fastens together after opening to thereby effectively seal the contents of the bag from the intrusion of unwanted air and moisture. One example of such a reclosable bag is the ZIPLOC® brand food storage bag manufactured by the Dow Chemical Company, the assignee of the instant application.

Both conventional and reclosable bags share a common feature in that they are usually formed from a continuous roll (web) of bag film. This bag film web is filled with the product (such as cereal) and the web is subdivided into a plurality of individual bags.

Machines for forming and filling bags from a continuous web of bag material are known.

Toss, U.S. Pat. No. 3,815,317 relates to an apparatus for forming, filling and sealing zippered plastic bags. A continuous bag film web is provided on a roll with the rib and groove profiles interlocked. The profiles are opened and the film spread out to remove any wrinkles or folds from the web. The film is then folded and the profiles are reengaged. The web is then cross-sealed, filled with the product through the remaining open side, and that open side is sealed to form the final bag assembly. In the Toss apparatus a pin unlocks the interlocked profiles. A guide device holds the profiles apart. The guide device includes guide wheels which engage the edges of the film. The profiles are reengaged through the use of closure rolls.

Tillman, U.S. Pat. No. 4,355,494 relates to a machine for making reclosable bags. The Tillman device is not a true form, fill and seal machine but rather a forming machine only. Tillman forms zippered bags by applying the rib and groove profiles to a traveling web. The bag film is then formed into a tube over a forming shoulder. The rib and groove profiles are joined by a guide means which is best shown in detail in FIGS. 4 and 5 of the Tillman patent. Tillman's guide means includes multiple roller pairs which are utilized to guide the profiles into engagement between a pair of press rolls.

Maxfield, U.S. Pat. No. 2,146,308, relates to a vertical form, fill and seal operation. A plastic film web is formed around a tube and then a capping strip is applied over the edges of the tube. This capping strip is positioned by a pair of heated rollers. The tube is filled and then laterally sealed and severed to produce the packaged product. The Maxfield device does not utilize zippered bag film. Rather, Maxfield utilizes a capped bag.

Pike, U.S. Pat. No. 3,807,118 also relates to a non-zippered form, fill and seal system. In the Pike device, a heat sealable minor web is applied to one edge of the web. A tear element is applied to the opposite edges. The two edges are aligned and heat sealed as part of the formation of the bag.

One difficulty encountered in both conventional and reclosable bag forming, filling, and sealing operations is maintaining the bag film from which the bags are cut in a proper alignment as the bag film travels through the forming, filling and sealing machine. This problem is especially acute in the forming, filling, and sealing of zipper-type reclosable bags, because the zipper halves need to be aligned properly in order to be closed properly.

It is therefore an object of this invention to provide an improved zipper closure and bag film aligning means for a packaging machine.

SUMMARY OF THE INVENTION

In accordance with the present invention, a steering, joining and guiding mechanism is provided for joining together opposing rib and groove fastener elements on a traveling, continuous bag film. The mechanism comprises a pair of opposed press rolls. The longitudinal axis of each of the press rolls is offset from about 2° to about 30° from the direction of travel of the bag film.

Preferably, the press rolls are offset at about 5° from the direction of travel of the bag film, and the press rolls are used in conjunction with a forming, filling, and sealing machine having a filling chute which includes a portion disposed interiorly of the bag film at the same point in the direction of travel of the bag film as the press rolls.

Thus, a feature of the present invention is that the press rolls of the present invention, having longitudinal axes which are offset from the direction of travel of the bag film, exert an outwardly directed force on the bag film as the fastening elements of the bag film pass through the rollers. This outwardly directed force pulls the bag film taut against a portion of the filling chute to maintain the bag film in a proper lateral orientation. By maintaining the bag film in a proper lateral orientation, the fastener elements are aligned to facilitate the interlocking of the fastener elements.

Another feature of the present invention is that at least one of the press rolls is mounted to a pivoting bracket to permit the one press roll to be moved relative to the other press roll. This moveable feature has the advantage of permitting the press rolls to be moved between a fastener engaging and a fastener releasing position. The placement of the press rolls in the fastener releasing position (wherein the press rolls are separated) facilitates the "threading" of the bag film through the press rolls.

Another feature of the present invention is that rubber press rolls are used. The rubber press rolls frictionally engage the bag film to grip the bag film securely and pull it outwardly, while permitting a sufficient amount of "slippage" to permit the bag film to travel in a path offset from the axes of the rolls.

Additional features and advantages of the present invention will become apparent to those skilled in the art upon consideration of the following detailed description of a preferred embodiment exemplifying the best mode of carrying out the invention as presently perceived.

DETAILED DESCRIPTION OF THE PREFERRED EMBODIMENTS

Figure 1:
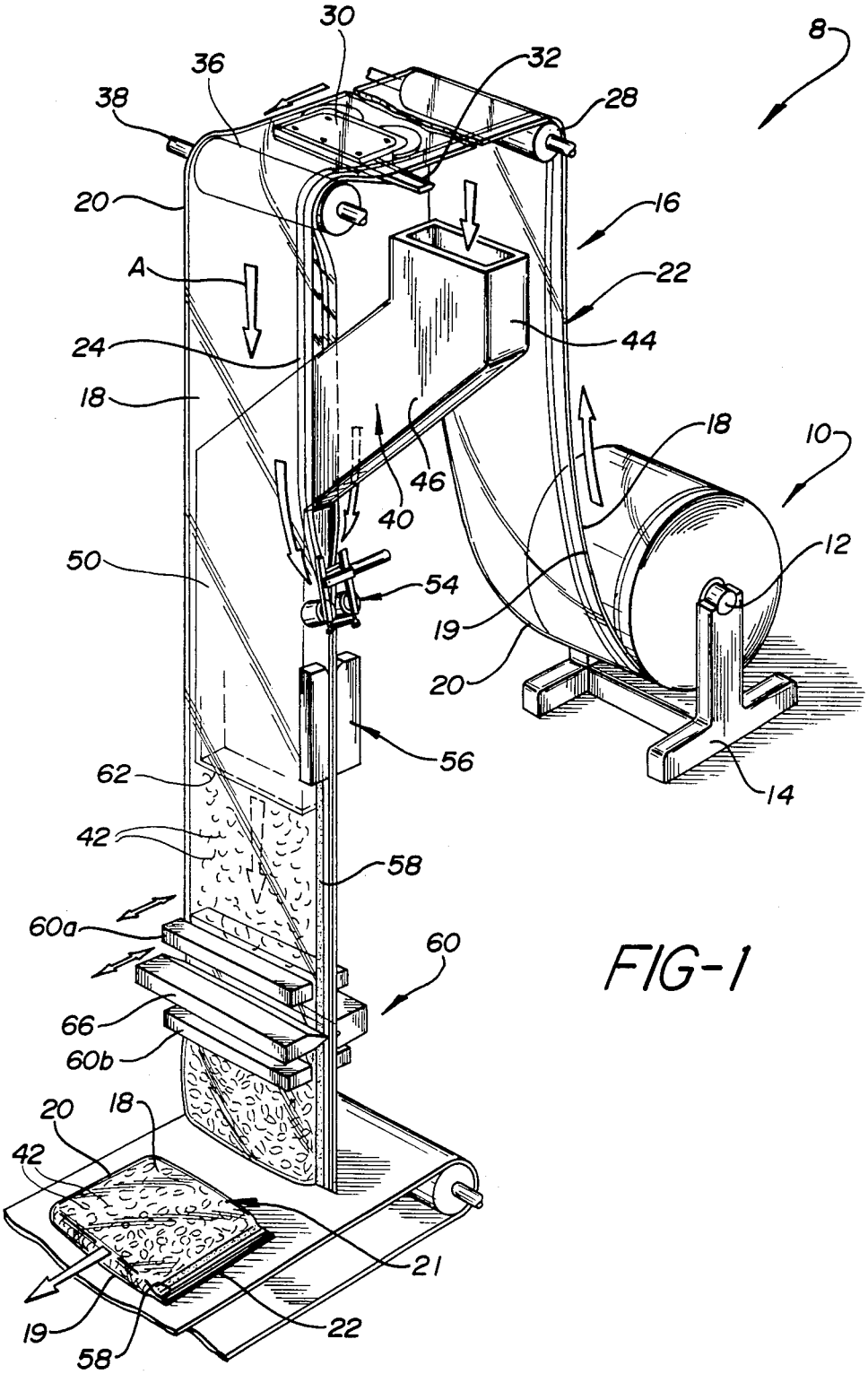
FIG. 1 is a perspective view of the form, fill and seal packaging machine of the present invention.

A form, fill and seal packaging machine 8 is shown in FIG. 1. The packaging machine 8 includes a means, such as bag film roll 10 for supplying a continuous web 16 of plastic bag film. Bag film roll 10 is supported by a spindle 12 which is rotatably journaled to a rack 14 for maintaining the roll 10 above the ground. The continuous web 16 of bag film is unwound from the roll 10 and is fed into the form, fill and seal portions of the packaging machine 8.

The web 16 is helically wound onto the roll 10, and as drawn from the roll 10 has a pair of opposed plies 18, 19. The opposed plies 18, 19 are continuous with each other at the bottom edge 20 (of a finished bag 21), and are interlocked at the top edge 22 (of the finished bag 21). The plies 18,19 are interlocked at top edge 22 by a zipper comprising a female fastener element 24 which is formed as a part of ply 19, and a male fastener element 26 which is formed as a part of ply 18. The fastener elements 24, 26 can be similar to the fastener elements found on ZIPLOC® brand food storage bags manufactured by The Dow Chemical Company, the assignee of the instant invention. The fastener elements 24, 26 permit the food storage bag to be reclosed after opening.

From the roll 10, the web 16 is drawn upwardly over a roller 28 by a feed mechanism (not shown) which is disposed downstream in the path of travel of the web 16. Although roller 28 is shown as a single roller, roller 28 preferably comprises a "dancer roll" system. The web 16 is then drawn through a guide mechanism 30. Guide mechanism 30 includes means for laterally aligning the web 16 and a splitting means, such as zipper-splitting edge 32 for disengaging the interlocked female and male fastener elements 24, 26. An example of such a guide mechanism 30 is described in more detail in an application by the same inventors entitled "Guide for Zippered Film," Ser. No. 889,551 which was filed simultaneously with the instant application on July 25, 1986.

An idler roller 36 is disposed directly downstream in the bag film web's 16 path of travel from the guide mechanism 30. The idler roller 36 is positioned at about the same vertical height as guide mechanism 30, and is rotatably journaled on a spindle 38. After the fastener elements 24, 26 have been disengaged by the zipper-splitting edge 32, both plies 18, 19 of the web 16 pass over the idler roller 36. Once over the idler roller 36, the web 16 travels generally vertically downwardly. This generally vertically downward direction of travel is indicated by arrow A. Due to the action of zipper-splitting edge 32, the fastener elements 24, 26 are disengaged as the web 16 passes over idler roller 36 and begins its downward travel.

A side arm filling station, such as filling chute 40 is provided for directing product, such as cereal pellets 42 into the interior of web 16. Filling chute 40 includes a generally vertically extending upper portion 44, an angled middle portion 46 and a generally vertically extending lower portion 50. The angled middle portion 46 passes between the disengaged fastener elements 24, 26 and into the interior of web 16. The generally vertically extending lower portion 50 is disposed in the interior of the web 16 between the plies 18, 19 of the web 16.

A steering, joining, and closing mechanism 54 for pressing together and re-interlocking the female and male fastener elements 24, 26 of the opposed plies 19, 18 is disposed in the path of travel of the web 16 directly downstream of the angled middle portion 46. More particularly, the steering, joining and closing mechanism 54 is disposed downstream of that portion of the angled middle portion 46 of filling chute 40 which passes between the fastener elements 24, 26. Although the steering, joining and closing mechanism 54 is disposed downstream of the angled portion 46, it is also disposed at the same general point in the direction of travel of the web 16 as a portion of the generally vertically extending lower portion 50 of the feed chute 40. The steering, joining and closing mechanism 54 will be described in more detail below.

A reciprocally moving, generally vertically extending seal forming bar 56 is disposed downstream of the steering, joining and closing mechanism 54. Seal forming bar 56 is provided for forming a temporary "peel seal" 58. In a finished bag, the peel seal 58 is formed interiorly of, and generally parallel to the fastener elements 24, 26. The peel seal 58 can be unsealed by the user without destroying the integrity of the finished bag. The peal seal 58 helps to make the finished bag more tamper resistant. Preferably, the length of seal forming bar 56 is approximately equal to the width of a finished bag.

A reciprocally moving, generally horizontally disposed seal forming means 60 having sealing bar elements 60*a* and 60*b* is disposed below the open lower end 62 of the feed chute 40. Preferably, seal forming means 60 is disposed at a distance from the open lower end 62 of the feed chute 40 which is approximately equal to the width of one finished bag 21. Sealing bar elements 60*a* and 60*b* are provided for laterally sealing together the first and second plies 18, 19 to form the side seals of the finished bag 21.

A severing means 66 is disposed between sealing bar elements 60*a* and 60*b*. The severing means 66 is provided for severing the intermittently sealed continuous web 16 into individual, finished bags 21.

Figure 2:
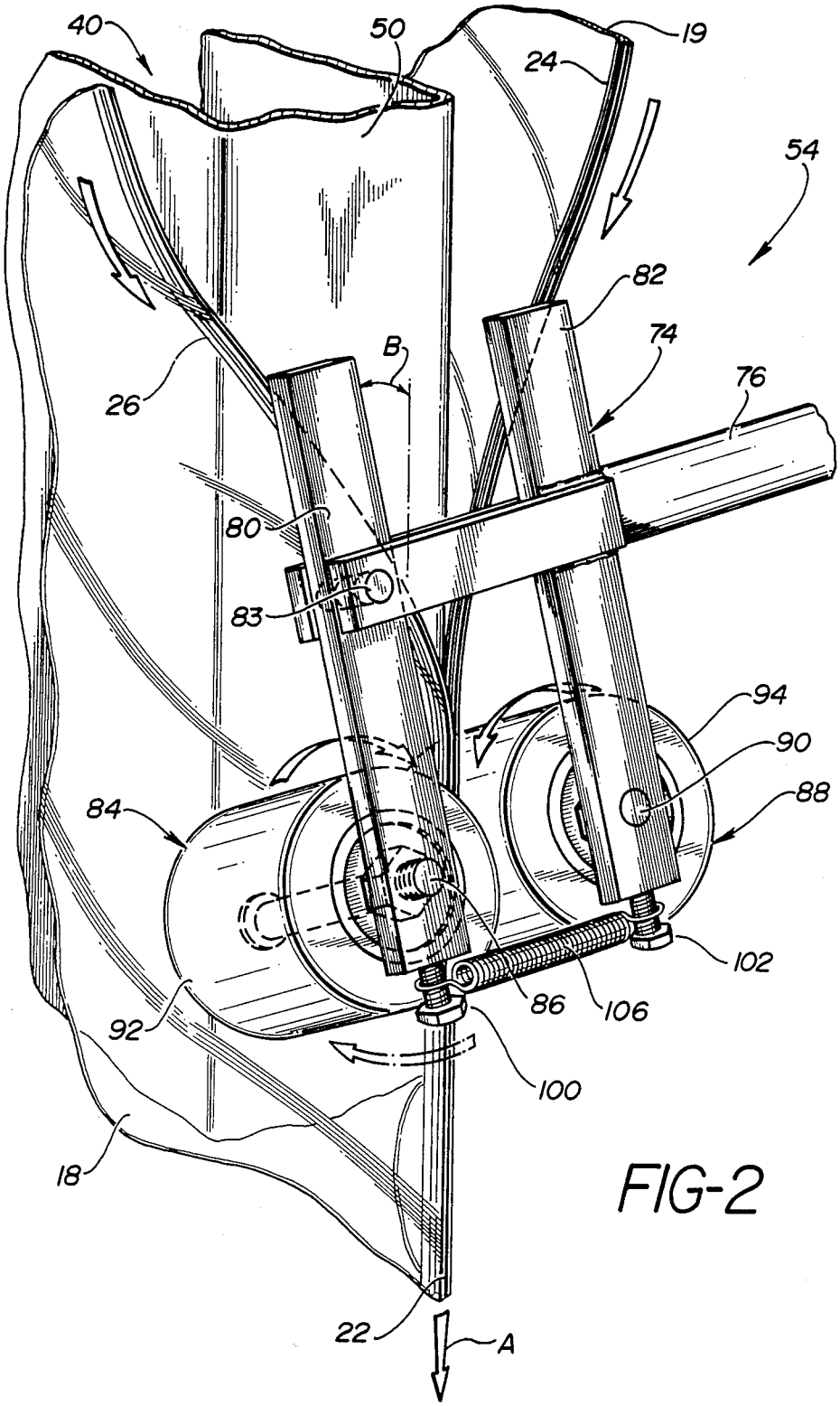
FIG. 2 is a perspective view of the steering, joining and closing mechanism of the present invention.
Figure 3:
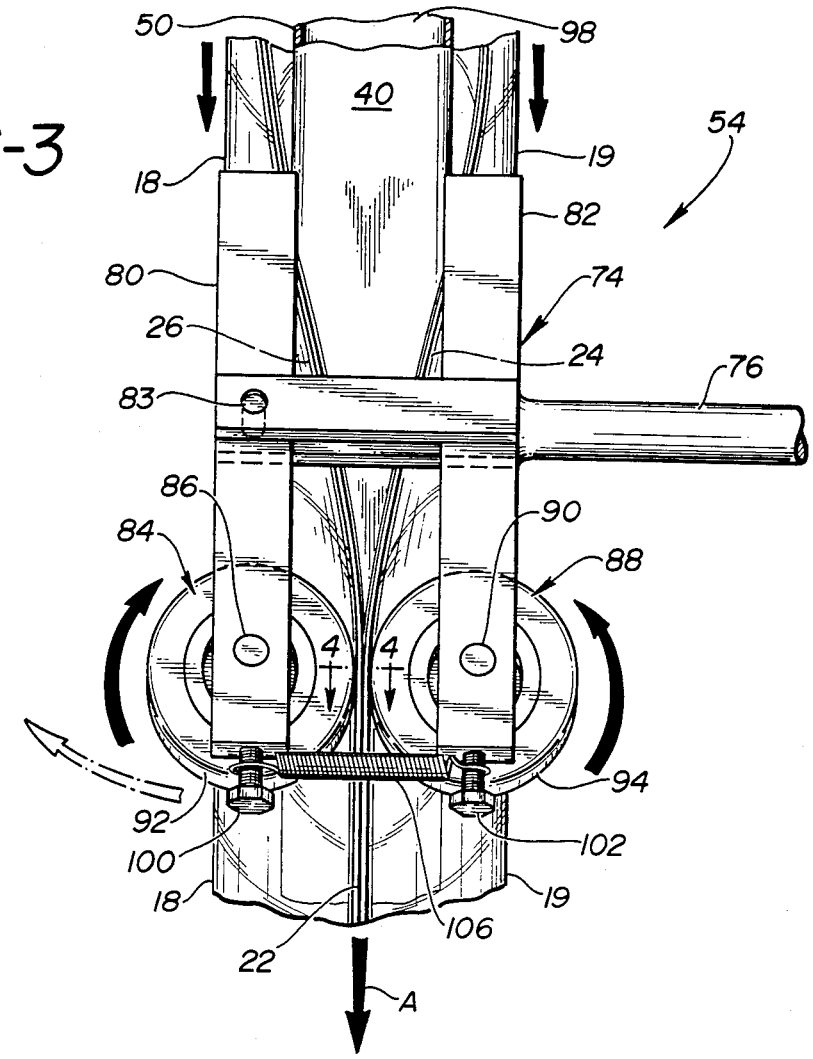
FIG. 3 is a side view of the steering, joining and closing mechanism of the present invention.
Figure 4:
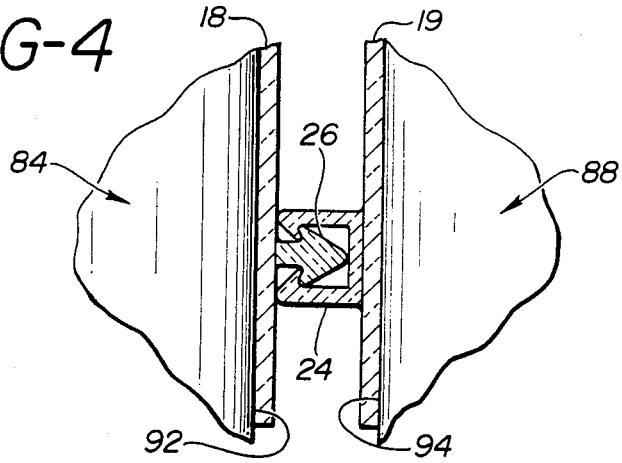
FIG. 4 is a greatly enlarged sectional view taken generally along the lines of 4—4 of FIG. 3.

The steering, joining and closing mechanisms 54 of the present invention is best shown in detail in FIGS. 2–4. The mechanism 54 includes an H-shaped bracket 74 which is supported by a side arm 76. The bracket 74 includes a cross brace member 78, a first, generally vertically extending leg 80 and a second, generally vertically extending leg 82. The first leg 80 is pivotally coupled to the cross-brace member 78 by a pivot pin 83. The second leg 82 is fixed to the cross brace member 78.

A first press roll 84 is rotatably journaled to the first leg 80 by an axle 86. A second press roll 88 is rotatably journaled to the second leg 82 by an axle 90, and is placed in an opposed relation to the first press roll 84. The press rolls 84, 88 are preferably made of a rubber material having a durometer hardness of between about 20 and 70 shore A. The press rolls 84, 88 each have a generally smooth, cylindrical surface, 92, 94, respectively, to engage and interlock the fastener elements 26, 24, respectively. The first and second press rolls 84, 88 interlock the fastener elements 26, 24 by pressing the respective fastener elements 26, 24 into engagement.

Axles 86,90 define the longitudinal axes about which the press rolls 84,88, respectively, rotate. These axes are parallel axes, and are offset from the direction of travel A of web 16. The angle at which the axes are offset from a line perpendicular to the direction of travel can be between about 2° and 30°. Preferably the axes are offset about 5°. The offset rolls 84, 88 exert a generally outwardly directed force against the web 16. This outwardly directed force pulls the web 16 taut against the side of the lower portion 50 of feed chute 40. By pulling the web 16 taut against the lower portion 50 of the feed chute 40, the press rolls 84, 88 maintain the proper lateral alignment of the web 16 in the area of the lower portion 50 of the feed chute 40. This laterally and outwardly directed force exerted by the press rolls 84, 88 also maintains the proper relative alignment of the fastener elements 24, 26, which facilitates the interlocking of the fastener elements 24, 26 by the press rolls 84, 88.

It has been found by applicants that if the axes of the press rolls 84, 88 are offset from a line perpendicular to the direction of travel A of the web 16 by less than 2°, the press rolls 84, 88 generally do not exert a sufficient outwardly directed force against the web 16 to pull the web 16 taut against the lower portion 50 of the feed chute 40. Thus, at an angle less than 2°, the press rolls 84, 88 do not serve to maintain the proper lateral alignment of the web 16. The applicants have also found that if the longitudinal axes of the press rolls 84, 88 are offset by greater than about 30°, the cross brace member 78 tends to interfere with the operation of the press rolls 84, 86.

A first post 100 is mounted to the bottom of first leg 80, and a second post 102 is mounted to the bottom of second leg 82. A biasing means such as an expansion spring 106 is stretched between the posts 100, 102 to pull the press rolls 84, 86 toward each other.

As discussed above the first leg 80, is pivotally coupled to cross brace member 78 by a pivot pin 83. This pivotal coupling permits the first leg 80, and hence first press roll 84, to move in an arc defined by the axis of the pivot pin 83, to permit first press roll 84 to be moved between a fastener element engaging position (as shown in the figures) and a fastener element releasing position. In the fastener element engaging position, the first press roll 84 is adjacent to the second press roll 88 to engage the fastener elements 26, 24 respectively, and interlock them. In the fastener element releasing position, the first press roll 84 is spatially separated from the second press roll 88. The press rolls 84, 88 can be sufficiently spatially separated to facilitate the threading of the fastener elements 24, 26 between the press rolls 84, 88. Absent this ability to move the press rolls 84, 88 between a fastener element engaging and a fastener element releasing position, the fastener elements 24, 26 would be difficult to thread through the press rolls 84, 88.

Spring 106 preferably exerts a sufficient compressive force to bias the press rolls 84, 88 into the fastener element engaging position while still permitting an operator to spread apart the press rolls 84, 88 into the fastener element releasing position. Preferably, a set of press rolls 84, 88 and spring 106 are chosen which will exert approximately a one pound force against the fastener elements 24, 26.

In this manner, it is possible to reclose the fastener elements while at the same time accurately guiding the bag web into the sealing mechanism. It has been found that such a system provides an efficient forming, filling, sealing machine for zippered bags.

Having described the invention in detail and by reference to preferred embodiments thereof, it will be apparent that modifications and variations are possible without departing from the scope of the invention defined in the appended claims.

What is claimed is:

1. In a form, fill and seal packaging machine, including means for supplying a continuous plastic bag film having interlocked reclosable fastener elements on respective opposing plies of said film, means for feeding said film through a filling station, a filling station for filling said film with product, means preceding said filling station for separating said fastener elements and guiding said film through said filling station, means for pressing said fastener elements together in an interlocking relationship, means for laterally sealing said bag film to form a bag assembly having first and second side seams, and means for severing said bag assembly from said bag film, the improvement wherein said means for pressing said fastener elements together in an interlocking relationship includes a pair of opposing press rolls, the longitudinal axis of each of said rolls being offset from about 2° to 30° from a line perpendicular to the direction of travel of said bag film and said filling station includes a portion disposed interiorly of said opposing plies of said bag film at generally the same point in the direction of travel of the bag film as said opposing press rolls, said filling station and press rolls being cooperatively positioned to permit the press rolls to pull the bag film against the filling station.

2. The improvement of claim 1 wherein said press rolls are offset about 5° from a line perpendicular to the direction of travel of said bag film.

3. The improvement of claim 1 wherein said press rolls comprise a pair of rubber press rolls having a durometer hardness of between about 20 and 70 shore A.

4. The improvement of claim 1 further comrising a bracket means for supporting said pair of press rolls, the bracket means including a first bracket member for supporting one of the pair of press rolls and a second bracket member for supporting the other of the pair of press rolls, at least one of the first and second bracket members being movable to permit at least one of said pair of press rolls to be moved between a fastener element engaging position and a fastener element releasing position.

5. The improvement of claim 4 further comprising a means for biasing said pair of press rolls into the fastener element engaging position.

6. A steering, joining and guiding mechanism for joining together opposing rib and groove fastener elements on a traveling continuous bag film comprising a pair of opposing press rolls, the longitudinal axis of each of said rolls being offset from about 2° to about 30° from a line perpendicular to the direction of travel of said bag film, and means for positioning said rolls to enable said rolls to pull said bag film against a filling station disposed interiorly of said bag film.

7. The invention of claim 6 wherein said press rolls are offset at about 5° from the direction of travel of said bag film.

8. The invention of claim 6 wherein said press rolls comprise a pair of rubber press rolls having a durometer hardness of between about 20 and 70, Shore A.

9. The invention of claim 6 further comprising a bracket means for supporting said pair of press rolls, the bracket means including a first bracket member for supporting one of the pair of press rolls and a second bracket member for supporting the other of the pair of press rolls, at least one of the first and second bracket members being movable to permit at least one of said pair of press rolls to be moved between a fastener element engaging position and a fastener element releasing position.

10. The invention of claim 9 further comprising means for biasing said pair of press rolls into the fastener element engaging position.

* * * * *